US005263882A

United States Patent [19]

Peterson

[11] Patent Number: 5,263,882

[45] Date of Patent: Nov. 23, 1993

[54] ELECTRICAL CONNECTOR WITH IMPROVED TERMINAL RETENTION MEANS

[75] Inventor: Bruce A. Peterson, Schaumburg, Ill.

[73] Assignee: Molex Incorporated, Lisle, Ill.

[21] Appl. No.: 978,115

[22] Filed: Nov. 2, 1992

[51] Int. Cl.[5] ..... H01R 13/40

[52] U.S. Cl. ..... 439/733; 439/869

[58] Field of Search ..... 439/733, 741, 869, 80, 439/81, 82, 84

[56] References Cited

U.S. PATENT DOCUMENTS

| | | | |
|---|---|---|---|
| 4,262,983 | 4/1981 | Bogese, II | 439/741 |
| 4,575,176 | 3/1986 | Castello et al. | 439/741 |
| 4,607,907 | 8/1986 | Bogursky | 339/258 P |
| 4,826,453 | 5/1989 | Glomb et al. | 439/595 |
| 4,857,001 | 8/1989 | Nakano et al. | 439/733 |
| 4,966,557 | 10/1990 | Barkus et al. | 439/246 |

FOREIGN PATENT DOCUMENTS

| | | | |
|---|---|---|---|
| 890402 | 2/1962 | United Kingdom | 439/733 |

*Primary Examiner*—P. W. Echols

*Attorney, Agent, or Firm*—Stephen Z. Weiss

[57] ABSTRACT

A retention system is provided for an electrical connector which includes a dielectric housing having at least one terminal-receiving cavity. A terminal is insertable through an insertion face of the housing into the cavity. The terminal is stamped from metal material and includes a generally planar retention body portion press-fit into the terminal-receiving cavity. A groove is provided in the housing communicating with the cavity and the insertion face of the housing. The groove has opposite side walls extending in an insertion direction of the terminal. The terminal includes a retention boss stamped from the body portion and insertable into the groove. The boss has side walls establishing a force-fit with the side walls of the groove. preferably, the boss is generally peanut-shaped in cross-section to define a pair of enlarged lobe portions providing four points of contact with the side walls of the groove.

13 Claims, 2 Drawing Sheets

ELECTRICAL CONNECTOR WITH IMPROVED TERMINAL RETENTION MEANS

FIELD OF THE INVENTION

This invention generally relates to the art of electrical connectors and, particularly, to an improved system for retaining terminals, such as stamped metal terminals, in cavities within a dielectric housing.

BACKGROUND OF THE INVENTION

A wide variety of electrical connectors are known of the type wherein a plurality of terminals are mounted within terminal-receiving cavities of a dielectric or plastic housing by a force or press-fit. In essence, the terminals are pressed or pushed into contact-receiving cavities or passages during assembly of the connector. The terminals are positioned at a desired location in the cavity or passage during manufacture and remain in that position during use of the connector. Therefore, proper alignment and spacing of the terminals is important.

Various forms of retention systems have been used to retain such terminals in their respective cavities or passages in the connector housing. Often, the terminals are retained within the cavities by a frictional fit. Most often, such terminals are stamped and formed components of sheet metal material. A common type of retention system utilizes edges of the stamped terminal which fit into a slot-like cavity in the housing and having laterally extending teeth which skive or cut into the plastic material of the housing, within the slot, to prevent the terminal from being withdrawn.

Problems have been encountered with terminal retention systems as described above. Theoretically, the configuration and dimensions of the terminals, along with the dimensions of the housing cavities or slots, are such as to have a predictable retention value and/or alignment capability. In reality, the frictional fit cannot be predicted with certainty. The skiving teeth are designed to cut into the plastic material within the housing slot to prevent withdrawal of the terminal from the housing. Often, the torn or cut slot is damaged to an extent that accurate alignment is not possible.

In addition, with the ever-increasing miniaturization and high density terminal configurations of contemporary electronic connectors, the terminals are received in smaller and smaller connectors with decreasing terminal center-line spacing, which results in thinner and thinner housing walls separating the terminals. When edges of a stamped terminal, with or without skiving teeth, cut into the material of the dielectric housing, the housing actually can be caused to split or crack.

This invention is directed to solving these problems by providing an improved retention system for electrical connectors of the character described.

SUMMARY OF THE INVENTION

An object, therefore, of the invention is to provide a new and improved terminal retention system in an electrical connector which includes force-fit stamped metal terminals.

In the exemplary embodiment of the invention, an electrical connector includes a dielectric housing having at least one terminal-receiving cavity. A terminal is insertable through a face of the housing into the cavity. The terminal is stamped of sheet metal material and includes a mating portion at one end, a terminal portion at an opposite end and a retention body portion therebetween. The terminal body portion is generally planar and defines opposite side faces and opposite side edges. The terminal-receiving cavity includes a retention section defined by opposite side walls in proximity to the side faces of the terminal body and opposite end walls in proximity to the side edges of the terminal body.

The invention contemplates the provision of a groove in the housing communicating with the terminal-receiving cavity and the insertion face of the housing. The groove has opposite side walls extending in an insertion direction of the terminal and generally perpendicular to the planar terminal body portion. The terminal includes a retention boss stamped from the terminal body portion and insertable into the groove. The boss has side walls establishing a force-fit with the side walls of the groove. Therefore, edge portions of the stamped terminal are not used to retain the terminal within the housing and does not cut into or skive the dielectric material of the housing.

Generally, the invention contemplates that the retaining/alignment boss establish a multiple point engagement with the housing, the points of engagement being spaced in the insertion direction of the terminal to facilitate and maintain proper alignment of the terminal. At least one side wall of the boss has at least a pair of lobe portions spaced in the insertion direction of the terminal for forcibly engaging a respective one of the side walls of the groove in the housing. Preferably, both side walls of the boss have a pair of the spaced lobe portions for forcibly engaging the opposite side walls of the groove. In the preferred embodiment, the boss is generally peanut-shaped in cross-section generally parallel to the planar terminal body portion to define a pair of enlarged lobe portions providing four points of contact with the side walls of the groove.

Another feature of the invention contemplates the provision of a recessed area in at least one side edge of the terminal body portion. The dielectric housing is fabricated of plastic material sufficiently compliant to expand into the recessed area in response to press-fit of the one side edge of the terminal against the adjacent end wall of the housing cavity section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
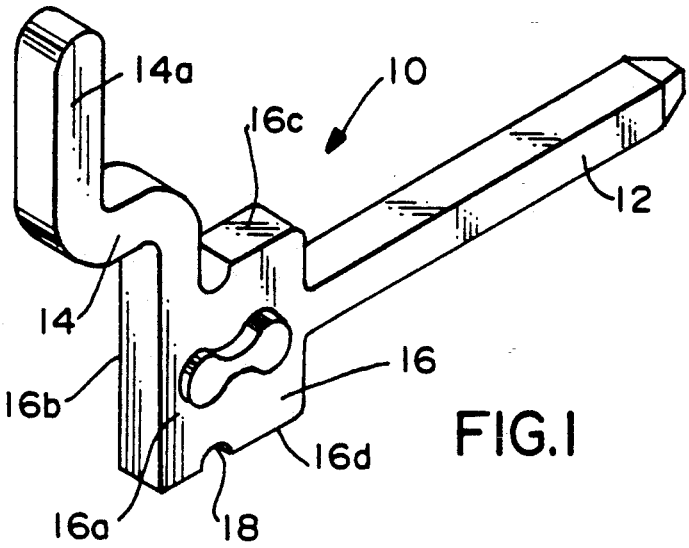
FIG 1 is a perspective view of a terminal incorporating the improved retention means of the invention.
Figure 3:
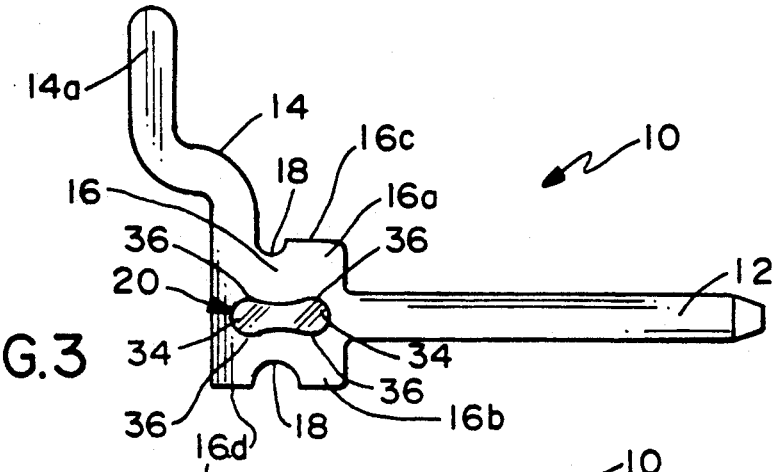
FIG. 3 is a plan view of the terminal of FIG. 1, illustrating its stamped configuration.
Figure 4:
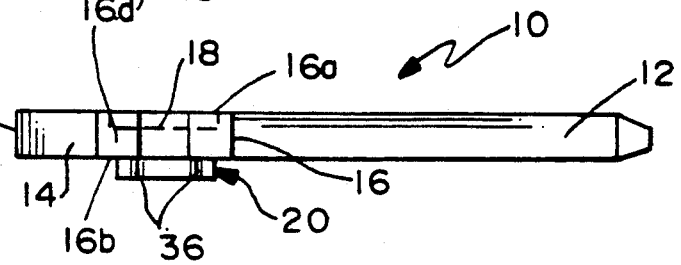
FIG. 4 is a side or edge elevational view of the terminal.

Referring to the drawings in greater detail, and first to FIGS. 1, 3 and 4, the retention system of the invention is embodied in an electrical connector which includes a plurality of terminals, generally designated 10, which are stamped and formed from sheet metal material. Each terminal includes a mating portion 12 at one end, a terminal portion 14 at the opposite end, and with a retention body portion 16 therebetween. Mating portion 12 is configured as a contact pin for mating with a female terminal of a complementary mating electrical connector (not shown). Terminal portion 14 is a tail portion for coupling to a circuit trace on a printed circuit board. In the exemplary embodiment of the invention, the terminal portion includes a foot 14*a* for surface mounting to a circuit pad or trace on the circuit board. Retention body portion 16 is an enlarged portion of the terminal and is generally planar to define opposite side faces 16*a* and 16*b* and opposite side edges 16*c* and 16*d*. Each side edge includes a cut-out or recessed area 18, for purposes described hereinafter. Lastly, each terminal 10 includes a retention boss, generally designated 20, stamped from the planar terminal body portion 16 so as to project therefrom, as best seen in FIGS. 1 and 4. The precise configuration and function of retention boss 20 will be described below, but FIGS. 1 and 3 show that the retention boss is generally of a "peanut" shape.

Figure 2:
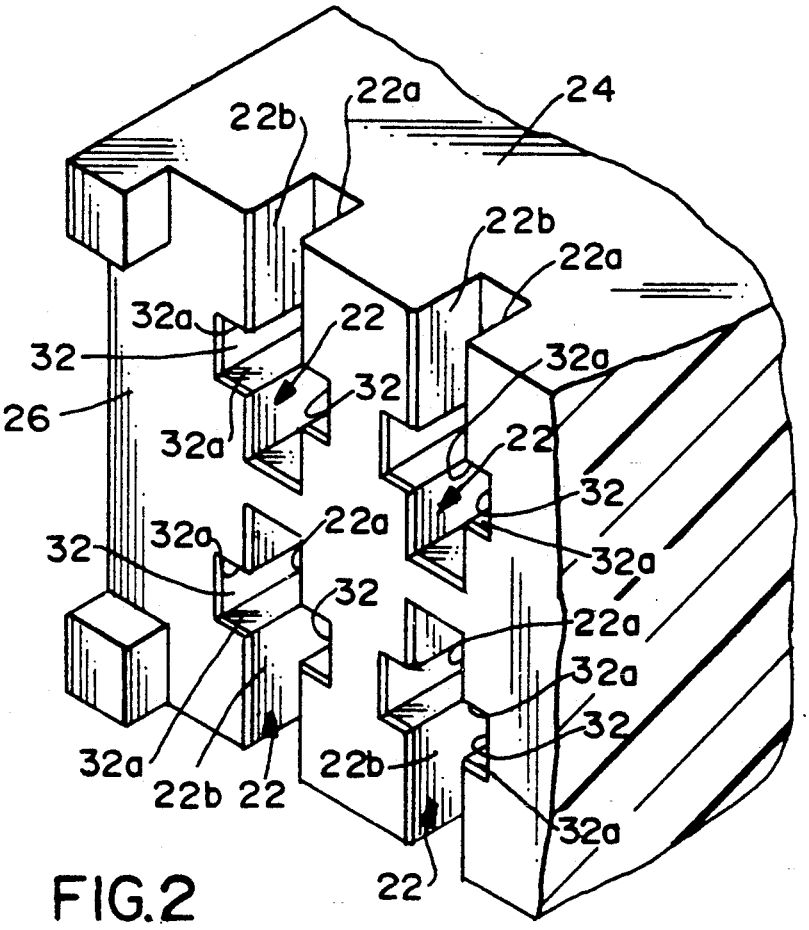
FIG. 2 is a fragmented perspective view of the dielectric housing and its terminal-receiving cavities.
Figure 5:
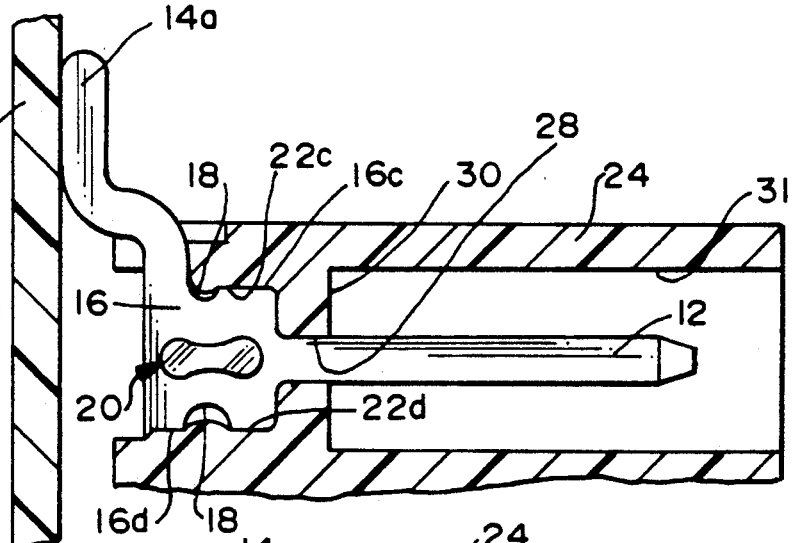
FIG. 5 is a fragmented section through the housing and one of the properly positioned terminals.

Referring to FIGS. 2 and 5, terminals 10 are mounted within respective terminal-receiving cavities, generally designated 22 (FIG. 2), in a dielectric housing 24 which is unitarily molded of plastic material or the like. Each terminal-receiving cavity communicates with an insertion face 26 of the housing for insertion of the respective terminal thereinto, and a channel 28 (FIG. 5) in the housing communicates between the terminal-receiving cavity and a mating face 30 of the housing so that mating pin portion 12 of the terminal projects from the mating face for interengagement with a female terminal of the complementary mating connector. Actually, as seen in FIG. 5, mating face 30 of the housing is disposed within a receptacle 31 which receives a plug portion of the complementary mating connector.

As best seen in FIG. 2, each terminal-receiving cavity 22 is of a slot configuration defined by opposite side walls 22*a* and 22*b* which are in proximity to side faces 16*a* and 16*b*, respectively, of a respective terminal 10 when inserted into the cavity. The cavity also is defined by opposite end walls 22*c* and 22*d* (FIG. 5) which are in proximity to side edges 16*c* and 16*d* of the inserted terminal. Lastly, a generally rectangularly shaped groove 32 is formed in the housing in communication with each cavity 22 as well as in communication with insertion face 26 of the housing. The groove includes side walls 32*a* extending in the insertion direction of the terminal and generally perpendicular to the planar terminal body portion 16 of the terminal when inserted into the cavity.

Generally, the retention system of the invention contemplates the provision of a multiple-point contact between each terminal 10 and housing 24 and a respective groove 32 within the housing, whereby the retention means is independent of the interengagement between planar terminal body portion 16 of each terminal and the respective terminal-receiving cavity. In addition, the multiple points of contact facilitate alignment of the terminals.

Figure 6:
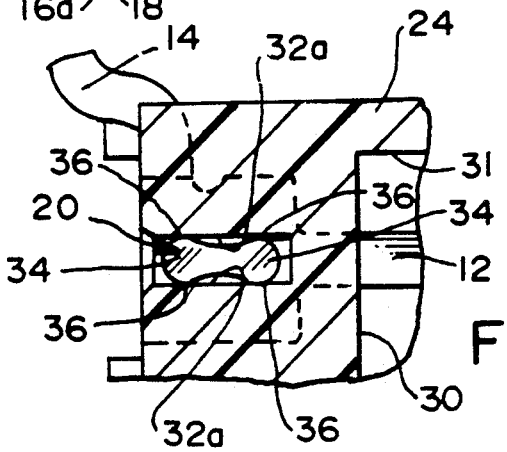
FIG. 6 is a fragmented sectional view through a portion of the housing in the area of the retention means between a terminal and the housing.

More particularly, referring to FIG. 6 in conjunction with FIG. 2, retention boss 20 can be seen in FIG. 6 to be of a generally "peanut" shape, as stated above. In other words, this shape defines a pair of enlarged lobe portions 34 which, in turn, define four points of contact 36 for engaging side walls 32*a* of groove 32 which communicates with the respective terminal-receiving cavity 22. Therefore, the retention boss projects from the planar terminal body portion 16 of the terminal into the groove. The retention boss is sized so that lobe portions 34 are tightly force-fit into the groove to establish a tight fit between the four contact points 36 of the retention boss and side walls 32*a* of the groove. Two spaced points of contact are established against each side wall of 15 the groove in the longitudinal or insertion direction of the terminal. These spaced contact points facilitate properly aligning the terminal. By stamping the peanut-shaped retention boss out of the planar retention portion 16 of the terminal, the boss is hollow and can be compressed to establish a tight fit within the housing groove. In addition, the side walls of the retention boss are smooth for engaging the flat side walls of the groove so that there are no sharp edges for cutting into or skiving the plastic material of the housing. Still further, the alignment and retention function of the retention boss and housing groove are independent of the press-fit of the planar terminal body portion 16 of the terminal.

As stated above, each side edge 16*c*,16*d* of planar terminal body portion 16 is provided with a cut-out or recessed area 18. The dimensions of each terminal-receiving cavity 22 and a respective terminal 10 are such that the side edges of the terminal body portion are press-fit into the cavity against end walls 22*c*,22*d* of the housing. The housing is fabricated of plastic material sufficiently compliant that the material will expand, without skiving or carrying, into the recessed areas 18 in response to the press-fit of the side edges of the terminal against the end walls of the housing cavity. This provides still an additional retention feature for each terminal without cutting into the plastic material of the housing.

Lastly, FIG. 5 shows a section through housing 24 and illustrates a terminal 10 mounted therewithin, and with the foot 14*a* of the tail portion 14 of the terminal in surface engagement with a printed circuit board 40. This application of the invention is illustrated to emphasize the criticality of proper alignment of the terminals which is facilitated by the improved retention means of the invention. Specifically, feet 14*a* of a plurality of terminals must be maintained in a single plane for interconnection with circuit pads or traces on one side of the printed circuit board. This planar alignment of the feet is quite critical in such surface mount applications. Any deviance of one or more feet from the desired coplanar configuration will result in inconsistent or defective interconnections with the circuit pads on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector which includes a dielectric housing having at least one terminal-receiving cavity, a terminal insertable through an insertion face of the housing into the cavity, the terminal being stamped of sheet metal material and including a mating portion at one end, a terminal portion at an opposite end and with a retention body portion therebetween, the terminal body portion being generally planar and defining opposite side faces and opposite side edges, and the terminal-receiving cavity including a retention section defined by opposite side walls in proximity to the side faces of the terminal body portion and opposite end walls in proximity to the side edges of the terminal body portion, wherein the improvement comprises a groove in the housing communicating with the terminal-receiving cavity and the insertion face of the housing, the groove having opposite side walls extending in an insertion direction of the terminal and generally perpendicular to the planar terminal body portion, and the terminal including a retention boss stamped from the terminal body portion and insertable into the groove, the boss having side walls establishing a force fit with the side walls of the groove.

2. In an electrical connector as set forth in claim 1, wherein said boss is generally peanut-shaped in cross-section generally parallel to the planar terminal body portion to define a pair of enlarged lobe portions providing four points of contact with the side walls of the groove.

3. In an electrical connector as set forth in claim 2, wherein said section of the terminal-receiving cavity and the terminal body portion are relatively sized and configured for establishing a press-fit between the side edges of the terminal body portion and the end walls of the cavity section.

4. In an electrical connector as set forth in claim 1, wherein at least one side wall of said boss has at least a pair of lobe portions spaced in the insertion direction of the terminal for forcibly engaging a respective one of the side walls of the groove.

5. In an electrical connector as set forth in claim 4, wherein both side walls of said boss have a pair of said spaced lobe portions for forcibly engaging the opposite side walls of the groove.

6. In an electrical connector as set forth in claim wherein said section of the terminal-receiving cavity and the terminal body portion are relatively sized and configured for establishing a press-fit between the side edges of the terminal body portion and the end walls of the cavity section.

7. In an electrical connector as set forth in claim 6, wherein at least one side edge of the terminal body portion includes a recessed area.

8. In an electrical connector as set forth in claim 7, wherein said dielectric housing is fabricated of plastic material sufficiently compliant to expand into the recessed area in response to the press-fit of the one side edge of the terminal against the proximal end wall of the housing cavity.

9. In an electrical connector as set forth in claim 1, wherein said dielectric housing has a plurality of said terminal-receiving cavities and including a plurality of said terminals insertable into the cavities, the terminal portions of the terminals having generally coplanar feet portions for surface mounting to appropriate circuit traces on a surface of a printed circuit board.

10. An electrical connector, comprising:

a dielectric housing having at least one terminal-receiving cavity communicating with an insertion face of the housing, and a groove communicating with the terminal-receiving cavity and the insertion face of the housing and including opposite side walls extending in an insertion direction of the terminal; and a terminal insertable through the insertion face of the housing into the terminal-receiving cavity, the terminal being stamped of metal material and including a body portion having a retention boss stamped therefrom and projecting into the groove of the housing, the retention boss having side walls establishing a force-fit with the side walls of the groove.

11. An electrical connector as set forth in claim 10, wherein said retention boss is generally peanut-shaped in cross-section to define a pair of enlarged lobe portions providing four points of contact with the side walls of the groove.

12. An electrical connector as set forth in claim 10, wherein at least one side wall of said boss has at least a pair of lobe portions spaced in the insertion direction of the terminal for forcibly engaging a respective one of the side walls of the groove.

13. An electrical connector as set forth in claim 12, wherein both side walls of said boss have a pair of said spaced lobe portions for forcibly engaging the opposite side walls of the groove.

* * * * *